United States Patent [19]

Malmgren

[11] 3,983,737

[45] Oct. 5, 1976

[54] METHOD FOR MANUFACTURING A SUSPENSION DEVICE OUT OF MERCHANT ROUND STEEL

[76] Inventor: Per Åke Malmgren, Tvargatan 5, 98100 Kiruna, Sweden

[22] Filed: Mar. 26, 1975

[21] Appl. No.: 562,274

[52] U.S. Cl. ..... 72/377; 29/7; 61/45 B

[51] Int. Cl.[2] ..... B21K 1/44

[58] Field of Search ..... 72/377; 10/27 R; 29/7; 254/198; 61/45 B; 85/1 H; 248/339, 340; 59/93; 140/80

[56] References Cited

UNITED STATES PATENTS

| | | | |
|---|---|---|---|
| 498,890 | 6/1893 | Taylor | 29/7 |
| 589,023 | 8/1897 | Parker | 254/198 |
| 1,120,411 | 12/1914 | Rohmer | 61/45 |
| 1,298,051 | 3/1919 | Keator | 59/93 |
| 1,313,807 | 8/1919 | Frazier | 248/339 |
| 2,268,772 | 1/1942 | Peterson | 72/377 |
| 2,862,368 | 12/1958 | Dempsey | 248/339 |
| 3,042,354 | 7/1962 | Goodwin | 248/339 |
| 3,651,651 | 3/1972 | Triplett | 61/45 |

*Primary Examiner*—Lowell A. Larson
*Attorney, Agent, or Firm*—Sughrue, Rothwell, Mion, Zinn and Macpeak

[57] ABSTRACT

Method of manufacturing a suspension bolt, the bent part of which has a bending strength corresponding to the tensile strength of the shank of the bolt, using commercial round iron and making the bolt from one single round work piece. In a first step the round work piece is cold bent to form an end for the hook part in the shape of a closed, oval ring, the largest part of which extends laterally to the longitudinal direction of the shank. In a second step the material of said ring is pressed or rolled, also by cold working, perpendicularly to the plane of the ring and up to the straight part of the shank, so that the section of the work piece in the pressed part becomes almost rectangular. In a third step the end of the ring is skewed laterally perpendicularly to the plane of the ring, so as to form an opening sufficient for engaging the line, the chain or any other attachment means intended to carry the loading.

3 Claims, 4 Drawing Figures

METHOD FOR MANUFACTURING A SUSPENSION DEVICE OUT OF MERCHANT ROUND STEEL

The invention relates to a method for manufacturing a mine roof bolt out of commercial round iron, the bent part of which has a bending strength substantially corresponding to the tensile strength of the shank part of the device or bolt.

Suspension devices or roof bolts of this type are principally used in mines and rock cavities for suspending charges, conduits or cables etc, for instance in the form of expansion bolts fixed in the roof of the mine or the rock cavities, in the wall or along the shaft leading to the mine or to the cavity. Such bolts can be subjected to very high loads, especially when they are used for air or fluid conduits. A current type of such a roof bolt is dimensioned for a load of 250 kg which means that under fourfold security requirements the bolt has to be able to carry a loading of 1000 kg.

In addition to this requirement of withstanding great loadings the roof bolts have to be very cheap considering that the amount of them needed is very large, ranging to about 100,000 bolts a year in a single mine. Therefore cheap iron is used, for instance commercial round iron 1311, whereby for this type of roof bolt one can use ½ inch commercial round iron with a tensile strength exceeding 1000 kg. It is, however, not possible for this purpose to bend such iron into a hook, since the hook part would not posses the required bending strength. For cost reasons it is not desirable either to increase the dimension of the utilized commercial round iron. Therefore this problem has been commonly solved by welding onto a half inch commercial round iron blank a hook made of flat iron, having a bending strength corresponding to the tensile strength of the bolt.

Figure 1:
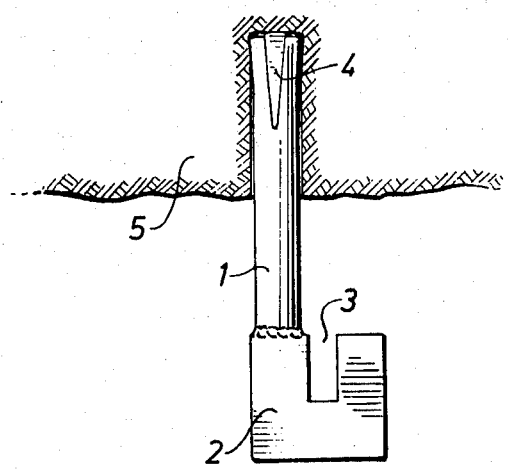

FIG. 1 is a schematic view of a roof bolt commonly used nowadays. A flat iron hook 2 provided with a cutting 3 is welded onto a commercial round iron shank 1. In FIG. 1 the shank part is shown as an expansion bolt wedged into the mountain wall 5 or the like by means of a key 4.

However, even such a bolt is not entirely satisfactory in terms of manufacturing and resistance. The manufacturing involves many rather complicated steps and the weld joints have to be carefully controlled.

The object of the present invention is to eliminate these disadvantages and to accomplish a suspension device or roof bolt, the hook part of which has a bending strength substantially corresponding to the tensile strength of the shank part of the bolt, said device being easy and cheap to manufacture and to use while ensuring that the line, the chain or any other attachment means intended to carry the loading can easily be fastened in the hook and not unintentionally be released from it.

The method according to the invention is principally characterized in that the device is made of one single round work piece, that in a first step the round work piece is cold bent to form an end for the hook part substantially in the shape of a closed, suitably oval ring, the largest part of which is extending, e.g. sideways to the longitudinal direction of the shank, that in a second step the material of said ring is pressed or rolled also by coldworking perpendicularly to the plane of the ring and substantially up to the straight part of the shank, so that the section of the work piece in the pressed part becomes almost rectangular, that simultaneously or in a third step the end of the ring is skewed sideways perpendicularly to the plane of the ring (cross-set), so as to form an opening sufficient for engaging the line, the chain or another attachment means intended to carry the loading.

It is suitable that the pressing perpendicularly to the plane of the ring is carried out so as to obtain an even transition to the circular section of the shank. It is also suitable to have the end of the ring extending past the center line of the shank by exerting transverse forces on the ring and thus by compressing it in its plane either simultaneously with the skewing or after the same.

If desired, the second and the third steps of the process can be carried out simultaneously in a single operation in a moulded pressure pad, for instance by means of an excentric press.

It has turned out that using the method according to the invention, it is possible to obtain with two or maximum four operation steps roof bolts having the same or a better resistance than the one of the roof bolt type shown in FIG. 1 and at substantially lower costs. At the same time the new bolts have a more suitable shape. Further, a line, chain or other attachment means for a charge can be engaged much easier in the hook part of the bolt according to the present invention that in previously known roof bolts. It is also possible, if desired, to lead the end of the suspension device according to the invention through the link of a loading chain and to suspend a hoist or other load on this chain.

Figure 2:
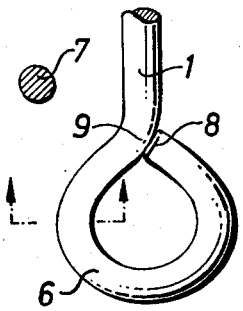
Figure 3:
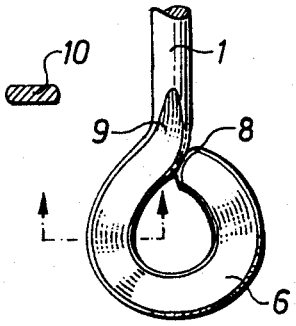
Figure 4:
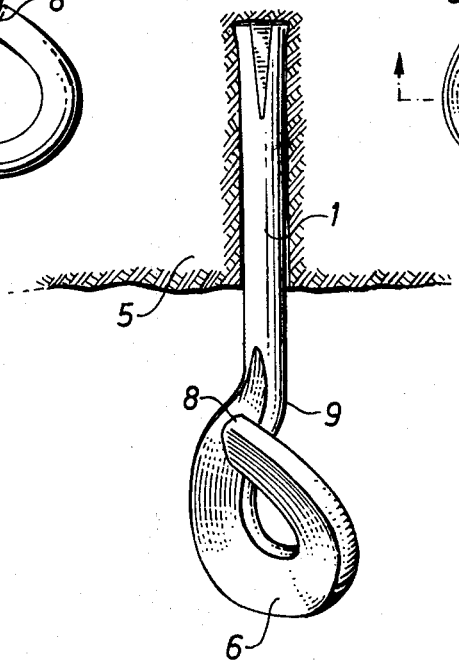

The invention will now be described with reference to the appended drawing, in which FIG. 2 shows the round work piece after the first step of the process, FIG. 3 shows the shape of the work piece after the second step of the process and FIG. 4 shows the final shape of the suspension device after the third and the fourth steps of the process.

It appears from FIG. 2 how in a first step the round work piece has been treated to form the end part of the hook in the shape of a substantially closed ring, somewhat oval latitudinally in relation to the longintudinal direction of the shank 1. The ring in the figure has the reference numeral 6 and from the section view to the left in the figure the ring appears to have a circular section 7. When bending the ring 6 it is suitable to let the end 8 of the work piece finish at a distance from the bent part 9 of the shank 1. The round work piece is bent by cold bending which can be carried out in any known way. An easy method in principle for forming the end for the hook part is to bend the round work piece around a mandrel with a lever arm provided with a bending roll.

The bending of said hook part can also be carried out in a series of tools mounted in a suitable power press whereby the bending is carried out by the different tools in partial steps.

FIG. 3 shows how the oval ring and the appertaining part of the shank in FIG. 2 will look, after having been pressed or rolled by cold working perpendicularly to the plane of the ring and up to the straight part of the shank. Thereby a pressure has been exerted on the work piece such that the section of the ring 6 has become almost rectangular 10 as shown to the left in FIG. 3. In cold pressing the ring to this section the bending strength has been increased so as to become substantially equal to the tensile strength of the shank 1.

Said pressing can be effected for instance in a hydraulic press, an excentric press or by blowing. The cold working can also be achieved by rolling.

It is also possible to carry out the third operation step, the side way skewing of the end of the ring perpendicularly to the plane of the ring, simultaneously with the pressing of the work piece perpendicularly to the plane of the ring. This can suitably be carried out in a single operation in a moulding pad, either in a hydraulic or in an excentric press.

FIG. 4 shows the final shape of the roof bolt after extending the end 8 of the ring past the center line of the shank by exerting transverse forces onto the ring, thus compressing the ring in its own plane after or simultaneously with the skewing. As appears from this figure, the pressing perpendicularly to the plane of the ring has been carried out in a fourth step with such a force that the round work piece is pressed down to a thickness corresponding to half its diameter. The advantage of this is, as experiments have proved, that sufficient bending rigidity is obtained in the hook part and that it is possible to pass the links of the loading chain over the end of the ring.

FIG. 4 also shows how a supporting bolt manufactured according to the method of the invention can be fixed, for instance in the roof 5 of a mine or of a rock cavity.

Although the invention has been described with reference to one embodiment it can nevertheless be arbitrarily varied within the scope of the subsequent claims. It is evident that suspension devices or supporting bolts manufactured according to the invention also are intended to be protected by the patent sought in the present application.

What is claimed is:

1. A method for manufacturing a one piece suspension roof bolt, adapted to be secured in drill holes of mining formations, from commercial round iron such that the bending strength of a bent eyelet part of the bolt is substantially equal to the tensile strength of the shank of the bolt, the bolt being formed from a single round work piece, comprising the steps of:

a. cold bending one end of the work piece to form an eyelet in the shape of a closed, oval ring having a radius of curvature of approximately twice the diameter of the bolt shank and having a largest dimension extending laterally to the longitudinal direction of the shank;

b. cold working the eyelet by pressing it in a direction perpendicular to the plane of the ring up to the shank, with a force such that the cross-section of the eyelet becomes substantially rectangular, the round work piece being pressed down to a thickness corresponding to approximately half its diameter;

c. bending the distal end of the ring laterally in a direction perpendicular to the plane of the ring, so that said end is skewed to form an opening; and d. applying a transverse force to the ring such that it is compressed in its plane, the end of the ring being extended past the center line of the shank and the radius of curvature of the ring being thus diminished.

2. The method according to claim 1, wherein the cold working of the eyelet by pressing perpendicularly to the plane of the ring is carried out by rolling to obtain an even transition to the circular section of the shank.

3. The method according to claim 1, wherein steps b) and c) are carried out simultaneously in a single operation in a moulding pad by means of an excentric press.

* * * * *